US005862773A

United States Patent [19]

Kaufman

[11] Patent Number: 5,862,773

[45] Date of Patent: Jan. 26, 1999

[54] RESILIENT FLAG ASSEMBLY

[76] Inventor: Carol G. Kaufman, 6 Fenimore Rd., Worcester, Mass. 01609

[21] Appl. No.: 744,189

[22] Filed: Nov. 5, 1996

Related U.S. Application Data

[60] Provisional application No. 60/006,246 Nov. 7, 1995.

[51] Int. Cl. [6] ..... G09F 17/00

[52] U.S. Cl. ..... 116/173; 40/606

[58] Field of Search ..... 116/173, 174, 116/63 P; 40/598, 608, 612, 606; 404/6, 9, 10

[56] References Cited

U.S. PATENT DOCUMENTS

| | | | |
|---|---|---|---|
| 3,119,370 | 1/1964 | Keats . | |
| 3,138,249 | 6/1964 | Paulini . | |
| 3,217,690 | 11/1965 | Mihalisin . | |
| 3,782,322 | 1/1974 | Wilson | 116/173 |
| 4,066,261 | 1/1978 | Stewart | 273/102 B |
| 4,241,774 | 12/1980 | Pell | 150/1.5 R |
| 4,400,878 | 8/1983 | Vaudreuil . | |
| 4,416,212 | 11/1983 | Howard | 116/173 |
| 5,127,871 | 7/1992 | Miller | 446/473 |
| 5,139,143 | 8/1992 | Pond | 206/373 |
| 5,233,938 | 8/1993 | Lalo | 116/173 |
| 5,244,715 | 9/1993 | Kuchar | 116/173 |
| 5,403,219 | 4/1995 | Ryan . | |
| 5,507,589 | 4/1996 | Jacobs | 404/11 |

*Primary Examiner*—Diego Gutierrez
*Assistant Examiner*—Andrew Hirshfeld
*Attorney, Agent, or Firm*—Blodgett & Blodgett, P.C.

[57] ABSTRACT

A flag or pennant which having a sheet of flexible material fixed to an elongated staff of closed cell thermoplastic foam material which is sufficiently rigid to be self supporting and sufficiently resiliently flexible to bend and sufficiently soft to compress when the staff is thrust forcibly against a person. More specifically, the staff is made of polyethylene having a density range of 3.5 pounds per cubic foot to 6.5 pounds per cubic foot.

2 Claims, 1 Drawing Sheet

RESILIENT FLAG ASSEMBLY

CROSS-REFERENCE TO RELATED APPLICATIONS

This application is a continuing application of Provisional Application No. 60/006,246, filed Nov. 7, 1995 (pending).

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention relates generally to a hand held flag or pennant of the type used for parades, sporting events, political rallies, parties, company outings, or other festive occasions. The invention is specifically directed to hand held toy flags primarily for use by children.

A traditional hand held toy flag consists of a sheet of flexible material such as cloth, paper, or plastic fixed to a staff of relatively stiff or rigid material such as a wooden dowel or a plastic rod. When children run with a traditional flag or use the flag in a vigorous "horsing around" manner, there is a chance that injuries could occur to the user of the flag or to bystanders. Injuries such as a poke int he eye can also occur to bystanders during normal use of the flag such as waving the flag at a parade or sporting event in close proximity to other people. These and other difficulties experienced with prior art flags and pennants have been obviated by the present invention.

A principle object of the present invention is the provision of a hand held flag assembly which is substantially less hazardous to use that conventional hand held flag assemblies.

Another object of the present invention is the provision of a hand held flag assembly which is rigid enough to be waved effectively and soft and flexible enough to be substantially safer than conventional flag assemblies.

A further object of the invention is the provision of a hand held flag assembly which is made of a material that is non-toxic.

BRIEF SUMMARY OF THE INVENTION

A flag or pennant which having a sheet of flexible material fixed to an elongated staff of closed cell thermoplastic foam material which is sufficiently rigid to be self supporting and sufficiently resiliently flexible to bend and sufficiently soft to compress when the staff is thrust forcibly against a person. More specifically, the staff is made of polyethylene having a density range of 3.5 pounds per cubic foot to 6.5 pounds per cubic foot.

DETAILED DESCRIPTION OF THE INVENTION

Figure 1:
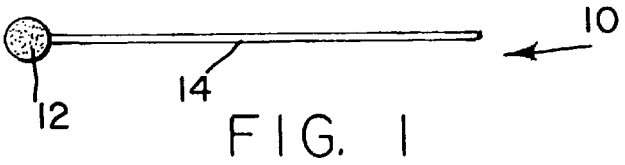
FIG. 1 is a top plan view of the flag assembly of the present invention.
Figure 2:
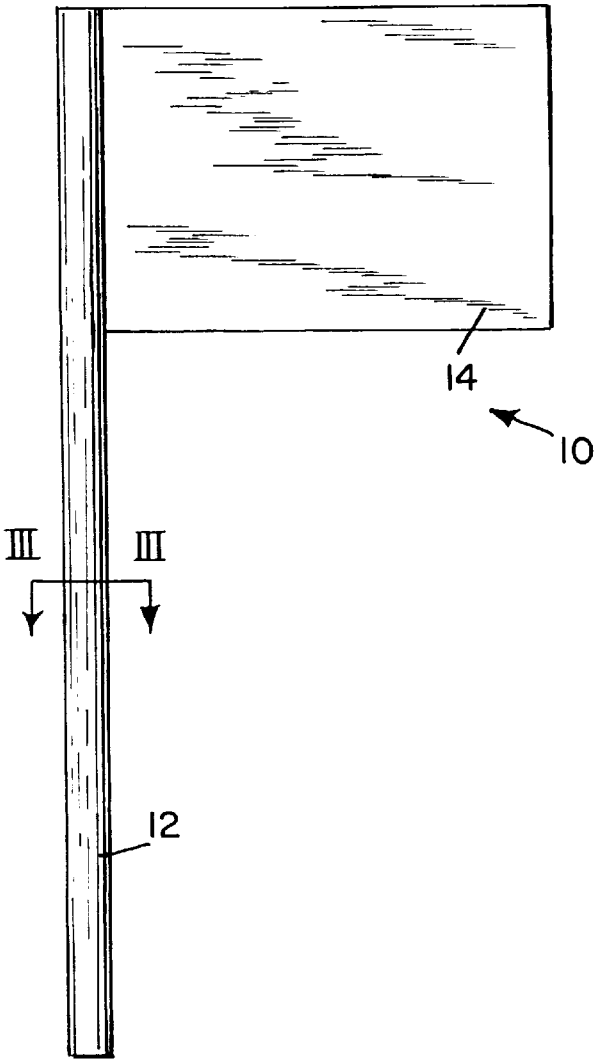
FIG. 2 is a side elevational view of the flag assembly.
Figure 3:
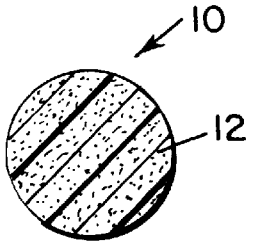
FIG. 3 is a horizontal cross-sectional view of the flag assembly, taken along the line III—III of FIG. 2 and looking in the direction of the arrows.

Referring to the drawings, the flag assembly of the present invention is generally indicated by the reference numeral 10 and comprises a staff 12 and a sheet of flexible material 14. The sheet 14 can be made of any natural or synthetic material. In the preferred embodiment of the invention, the sheet 14 is made of polyethylene.

The staff 12 is made of a closed cell thermoplastic material which is rigid enough to support itself and maintain its elongated shape during normal use as a hand held flag. The staff 12 is sufficiently soft to compress and resiliently flexible to yield or bend when the staff is brought forcibly against a person. When the flag 10 of the present invention is used during a festive occasion such as a party or parade, the staff 12 will bend and compress if a person is accidently struck by the flag during normal use (either the user of the flag or a bystander) so as to prevent injury to the person who has been struck by the flag. In the preferred form of the invention, the staff is made of a closed cell polyethylene foam material which has a density from 3.5 pounds per cubic foot to 6.5 pounds per cubic foot. Staffs made of closed celled polyethylene foam material within this density range are sufficiently stiff or rigid enough to be self supporting and to maintain their shape and are sufficiently soft and flexible enough for safe use during normal uses of the flag. The qualities of sufficient rigidity and flexibility are achieved by making the staff within an acceptable range of cross-sectional thickness. The range of acceptable cross-sectional thicknesses is dependant on the length of the staff. As a general rule, the longer the staff, the greater the cross-section of the staff. This relationship provides the required characteristics of the flag and at the same time preserves the esthetic quality of the flag. In the preferred embodiment of the invention, the staff is made of a closed-cell polyethylene foam material having a density from 3.5 pounds per cubic foot to 6.5 pounds per cubic foot. For a staff which is at least eight inches long, the diameter of the staff is proportional to its length in accordance with the following formula:

$$D'' = .5'' +/- .1'' + \frac{(L'' - 8'')}{40}$$

wherein D is the diameter of the staff and L is the length of the staff.

The sheet of flexible material 14 is attached to the staff by the use of contact adhesive, stitching, or ultrasonic welding or fusing. the sheet portion of the flag can be rectangular as in the case of a national flag or triangular as in the case of a pennant for sporting events.

What is claimed is:

1. A flag assembly for use in being held in a person's hand comprising;

(a) an elongated cylindrical staff consisting of closed cell polyethylene foam material having a density range from 3.5 pounds per cubic foot to 6.5 pounds per cubic foot, said staff being at least eight inches long and having a diameter proportional to its length in accordance with the following formula:

$$D'' = .5'' +/- .1'' + \frac{(L'' - 8'')}{40}$$

wherein D is the diameter of the staff and L is the length of the staff so that said staff is sufficiently rigid to be self supporting, sufficiently resiliently flexible to bend and sufficiently soft to compress when said flag assembly is brought forcibly against a person; and (b) a sheet of flexible material fixed to one end of the staff.

2. A flag assembly as recited in claim 1, wherein said sheet of flexible material is polyethylene.

* * * * *